United States Patent [19]

Miyazawa et al.

[11] 4,322,896

[45] Apr. 6, 1982

[54] SNOW BLOWING MACHINE

[75] Inventors: Takeshi Miyazawa, Wako; Naotoshi Ono, Sayama, both of Japan

[73] Assignee: Honda Giken Kogyo Kabushiki Kaisha, Tokyo, Japan

[21] Appl. No.: 165,681

[22] Filed: Jul. 3, 1980

[30] Foreign Application Priority Data

Jul. 7, 1979 [JP] Japan ..... 54-86065

[51] Int. Cl.[3] ..... E01H 5/00

[52] U.S. Cl. ..... 37/43 E

[58] Field of Search ..... 37/43 R, 43 E, 43 D, 37/50, 43 L

[56] References Cited

U.S. PATENT DOCUMENTS 3,043,028 7/1962 Merry et al. ..... 37/43 E
3,488,869 1/1970 Heth et al. ..... 37/43 R
3,603,008 9/1971 Heth ..... 37/43 E
4,203,237 5/1980 Enters et al. ..... 37/43 E

*Primary Examiner*—E. H. Eickholt
*Attorney, Agent, or Firm*—Armstrong, Nikaido, Marmelstein & Kubovcik

[57] ABSTRACT

A snow blowing machine is disclosed, in which collection and throwing of snow is effected by an auger and blower assembly rotating at high speed and which is in direct engagement with the ground, the auger and blower assembly having blades edged with an antifriction material which reduces the frictional engagement of the auger and blade assembly with the ground, the residual friction providing the motive force for moving the snow blowing machine across the ground, thus eliminating the requirement for a separate drive for that purpose, and also eliminating a separate drive to the blower.

4 Claims, 4 Drawing Figures

SNOW BLOWING MACHINE

BACKGROUND OF THE INVENTION

The present invention relates to a snow blowing machine of the type including a drive motor which supplies motive power to a rotating snow-gathering auger, the gathered snow being discharged laterally of the machine through an adjustable chute.

In such machines as are in common use, the auger is supported out of engagement with the ground and rotates at a relatively low speed in the order of thirty revolutions per minute. The auger includes helical blades of opposite hand which collect and push snow towards the center of auger, at which point the gathered snow is fed to a high speed blower at the base of an adjustable discharge chute and is forcably discharged from the chute in a direction lateral to the direction of travel of the snow blowing machine.

In such prior known machines, separate drives are provided to the auger and to the blower, with a consequential complication of the drive transmission. Additionally, in order to provide tractive force for moving the snow blowing machine over the ground, motive force is supplied from the drive motor to driven wheels of the machine by a drive transmission additional to that required for driving the auger and for driving the blower.

As a consequence of the necessity of providing separate drive transmissions to the auger, the high speed blower, and the drive wheels, respectively, the drive mechanism of such snow blowing machines is complex, cumbersome and relatively expensive to manufacture, and the weight of the snow blowing machine is substantially increased.

SUMMARY OF THE INVENTION

According to the present invention, the auger and the blower are integrated with each other into a single unit with the blower positioned between the dual helices of the auger and in axial alignment therewith, and the auger and blower assembly is driven at a speed sufficiently high for the blower to perform its intended function of discharging the collected snow through a chute associated with the blower section of the assembly.

By arranging the blower and the dual helices of the auger in axial alignment and rotating the auger and blower assembly at a speed sufficiently high for the blower to perform its intended function, the necessity of providing separate drives to the auger and to the blower is eliminated, thus effecting a further and substantial cost and weight saving.

According to another feature of the invention, the respective helices of the auger are edged with a material having a low coefficient of friction, and the auger is positioned in direct contact with the ground surface, and provides the required support for the front end of the snow blowing machine.

By virtue of the direct engagement of the auger and blower assembly with the ground surface, and the provision of an anti-friction ground engaging surfacing on the auger and the blower assembly, a minor portion of the motive force supplied to the auger assembly is made available to the snow blowing machine as a tractive force for moving the machine across the ground, thus eliminating the requirement for a separate drive to the support wheels of the snow blowing machine, with a consequential simplification of the drive mechanism and an effective cost and weight saving. Additionally, the support of the front end of the snow blowing machine by the auger and blower assembly eliminates the skids or wheels required to support the front end of the known snow blowing machine, thus effecting an additional cost and weight saving.

BRIEF DESCRIPTION OF THE DRAWINGS

The invention will now be described with reference to the accompanying drawings, in which.

DESCRIPTION OF THE PREFERRED EMBODIMENT

Figure 1:
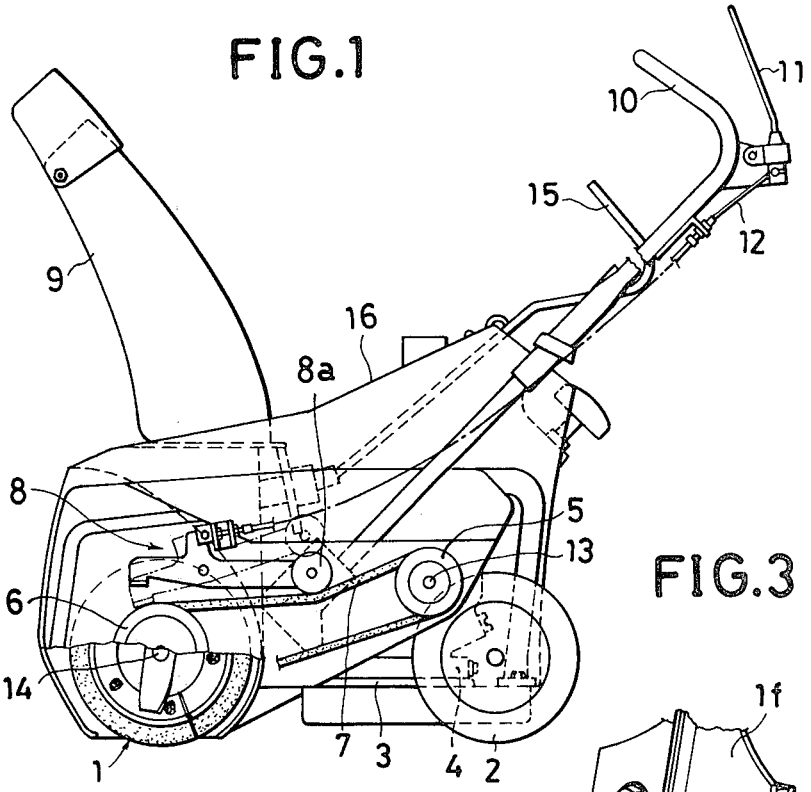
FIG. 1 is a side view, partly in section, of a snow blowing machine according to the present invention.
Figure 3:
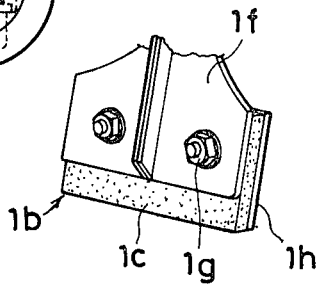
FIG. 3 is a fragmentary sectional perspective view of a blade of a blower of the snow blowing machine.

Referring more particularly to FIG. 1 of the drawings, the snow blowing machine of the present invention includes an auger 1 at the front end thereof and a pair of support wheels 2 at the rear end thereof. The body 3 of the snow blowing machine includes a drive motor, schematically indicated at 4, such as an internal combustion engine or an electric motor.

As the wheels 2 serve only to support the body of the snow blowing machine without supplying motive force for the traction of the machine, as hereinafter will become apparent, the wheels 2 are in fact optional, and may be replaced by one or more skids.

The drive motor 4 drives a shaft 13 on which is mounted a pulley 5 around which is entrained a drive belt 7, the drive belt also being entrained around a drive pulley 6 fast with an axle 14 of the auger. The belt 7 is of a length such that it must be tensioned in order to provide a drive from the pulley 5 to the pulley 6, in order that the pulley 5 may rotate freely without transmitting a drive to the pulley 6 until such time as the belt 7 is tensioned.

A mechanism for tensioning the belt 7 in order to provide the required drive is indicated generally at 8, the tensioning mechanism including an idler pulley 8*a* mounted on a swing arm, the position of which is controlled by a lever 11 through the intermediary of a flexible cable 12. Upon tensioning of the cable 12, the idler pulley is engaged with the drive belt 7 and tensions it sufficiently to prevent slippage at either the pulley 5 or the pulley 6, thus providing a direct drive between the driven shaft 13 of the motor 4 and the axle 14 of the auger.

Figure 2:
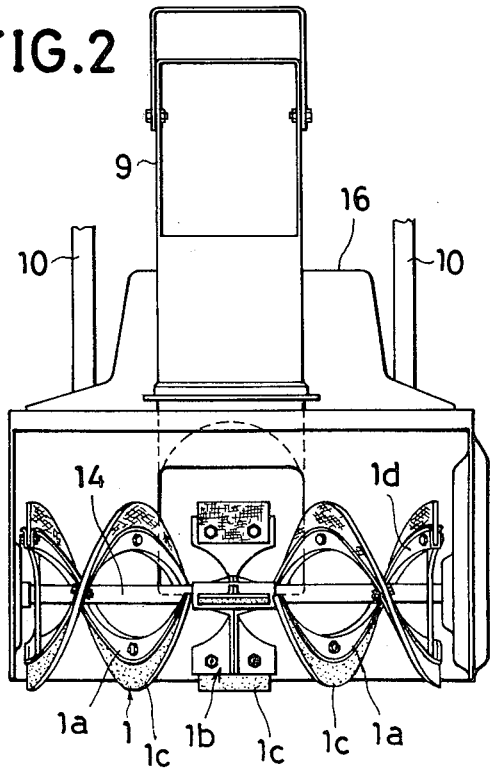
FIG. 2 is a front view of the snow blowing machine of FIG. 1.
Figure 4:
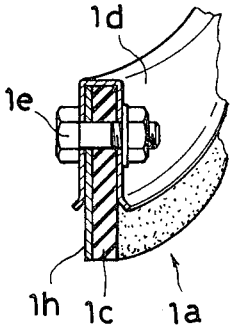
FIG. 4 is a fragmentary sectional perspective view of a helical blade of an auger of the snow blowing machine.

As will be seen more clearly in FIG. 2, the auger 1 includes dual auger portions 1*a* which are spaced axially from each other, the respective portions including helical channels which are supported from the auger axle 14 by radial spokes. As is conventional in the art, the helices of the respective sections of the auger are of opposite hand, in order that the auger shall gather snow and move it axially towards the center of the auger upon rotation of the auger in an appropriate direction.

Positioned intermediate the auger sections in a blower 1*b* having blades which extend substantially parallel to the axis of the auger shaft 14, the blower being positioned at the base of a discharge chute 9, supported on a cover 16 of the machine, and which extends upwardly of the snow blowing machine. The chute 9 is turnable by a control 15 to change the direction of the discharge of snow from the machine at the option of the control by the operator of the machine.

While the helical portions of the auger are shown as comprised by dual spiral blades, it will be understood that any number of blades can be employed. Further, while the respective blades are shown as supported on radial spokes, they could be solid members supported directly on the auger shaft 14.

The diameter of the auger and blower assembly is such that the auger directly contacts the ground, and provides the sole support for the front end of the snow blowing machine, the conventional support wheels or skids being omitted in their entirety.

Affixed to the outer edge of each of the helical blades 1*a* and the axial extending blades 1*b* is a strip of elastomer material 1*c* having a low coefficient of friction. While not limited thereto, the strip 1*c* can be formed of a hard rubber or of a synthetic plastics material such as polytetrafluoroethylene or Teflon (registered trademark), such materials being ones which are readily lubricated by water or melting now and ice in order to reduce the frictional contact thereof with the ground.

The strips of elastomer material are supported within the channels of the helical blades 1*b*, and are held therein by fasteners 1*e*. Similarly, the strips of elastomeric material 1*c* are attached to the axial blades 1*b* by means of fasteners 1*g* extending through plates 1*f* of the blower section 1*b*. Conveniently, for the purpose of reducing wear on the elastomeric material, the strips are backed with a cloth backing 1*h*. It will be understood that the strips 1*c* will be formed of a material which is sufficiently stiff to resist lateral collapsing of the strips under the weight of the snow blowing machine, especially when the machine is at rest.

By judicious positioning of the drive motor for its center of gravity to be close to the axis of rotation of the rear support wheels, the weight of the machine supported by the auger and blower assembly is reduced to an acceptable level at which rear and abrasion of the elastomer strips is minimized.

MODE OF OPERATION

In the rest position of the snow blowing machine of the present invention, with the motor 4 operating, the shaft 13 drives the pulley 5, the drive belt 7 at that time being untensioned. Prior to tensioning of the drive belt 7 the belt slips relatively to the pulley 5, any such driving of the belt as does occur being dissipated in slippage at the pulley 6.

On actuation of the clutch lever 11 to force the idler pulley 8*a* into engagement with the drive belt 7, the drive belt becomes tensioned establishing a direct drive between the pulleys 5 and 6, thus providing a direct drive from the motor shaft 13 to the auger shaft 14.

Immediately subsequent to the motive force supplied to the auger 1 exceeding the frictional restraint of its engagement with the ground, the auger will commence to rotate or "spin" at a high rotational velocity, the drive to the auger being of a ratio such that the speed of rotation of the auger is sufficiently high for the blower section 1*b* to perform its intended function of blowing and centrifugally impelling collected snow into the chute 9 for discharge out of the chute in the chosen direction laterally of the snow blowing machine.

When operating on snow covered ground, the snow itself acts as a lubricant for the elastomer material constituting the edges of the blades, thus materially reducing the frictional drag between the auger and the ground. There will, however, be residual friction acting in a direction to move the snow blowing machine in a forward direction, that residual friction being employed to provide the tractive force to the snow blowing machine in the absence of an independent drive to the rear support wheels 2.

As compared with the auger of a conventional snow blowing machine in which the auger is supported out of engagement with the ground and is rotated at a speed in the order of 100 revolutions per minute according to the present invention, the auger is rotated at a speed in the range of 1300 to 1500 revolutions per minute.

While a tensioned belt drive to the auger has been described, it will be appreciated that any other suitable form of drive providing a slipping clutch capability could be employed without departing from the spirit of the present invention.

The snow blowing machine described is to be taken by way of example only. Obviously, modifications and variations of the structure disclosed are possible without departing from the scope of the present invention, which is defined in the appended claims.

What is claimed is:

1. In a snow blowing machine of the type including a body, a drive motor mounted on said body, support members for said body, a snow discharge chute mounted on said body, a blower member associated with said chute, an auger having a shaft journalled for rotation on said body, said shaft carrying blade sections of opposite helix for collecting and feeding snow to said blower member, and a drive from said drive motor to said blower member and to said auger, the improvement comprising:

said helical blade sections of the auger being spaced axially of each other on said shaft;

said blower member being mounted on said shaft at a position intermediate said helical blade sections and having blades extending substantially axially of said auger shaft, said blades having edge members on the radially outermost edges of said blower member blades formed from a material having a low coefficient of friction, a drive from said motor to said auger shaft at a ratio such that said shaft is driven at a speed within the operating range of said blower, said auger having edge members on the peripheral edges of said helical blades formed from a material having a low coefficient of friction, said auger being in direct engagement with a ground surface and providing the sole ground engaging support for the front end of said body, and the residual friction between said edge members and said ground surface providing motive force for moving said snow blowing machine across said ground surface.

2. The improvement of claim 1, wherein said material of low coefficient of friction is polytetrafluoroethylene.

3. The improvement of claim 1, wherein said edge members comprise a strip of elastomer material and a cloth backing adhered thereto.

4. The improvement of claim 3, wherein said elastomer material is polytetrafluoroethylene.

* * * * *